US005611432A

United States Patent [19]

Dods

[11] Patent Number: 5,611,432

[45] Date of Patent: Mar. 18, 1997

[54] MODEL VEHICLE AND TRADING CARD PACKAGING SYSTEM

[75] Inventor: Robert E. Dods, Burr Ridge, Ill.

[73] Assignee: Racing Champions, Inc., Glen Ellyn, Ill.

[21] Appl. No.: 516,955

[22] Filed: Aug. 18, 1995

[51] Int. Cl.[6] ..... B65D 75/00

[52] U.S. Cl. ..... 206/459.5; 206/461

[58] Field of Search ..... 206/45.34, 232, 206/455, 459.5, 461, 831; 283/72, 74, 79, 117

[56] References Cited

U.S. PATENT DOCUMENTS

| | | | |
|---|---|---|---|
| 4,122,947 | 10/1978 | Falla | 283/74 |
| 4,905,828 | 3/1990 | Dods | 206/461 |
| 4,913,284 | 4/1990 | Versaci | 283/74 |
| 4,976,351 | 12/1990 | Mangini et al. | 283/74 |
| 5,040,671 | 8/1991 | Hager | 206/45.34 |
| 5,147,043 | 9/1992 | Gould | 206/459.5 |
| 5,263,586 | 11/1993 | Kaeble | 206/461 |
| 5,267,756 | 12/1993 | Molee et al. | 283/74 |
| 5,306,049 | 4/1994 | Schireck | 283/74 |

*Primary Examiner*—Jimmy G. Foster
*Attorney, Agent, or Firm*—Reinhart, Boerner, Van Deuren, Norris & Rieselbach, s.c.

[57] ABSTRACT

A packaging system for a model vehicle and a trading card. The model vehicle and trading card bear matching serial numbers. Another preferred embodiment includes a display stand for the model vehicle beating a matching serial number.

12 Claims, 3 Drawing Sheets

MODEL VEHICLE AND TRADING CARD PACKAGING SYSTEM

BACKGROUND OF THE INVENTION

The present invention relates generally to a packaging system for a model vehicle. More particularly, the present invention relates to a packaging system including a model vehicle bearing a serial number and a trading card bearing a matching serial number.

Historically, collectible items have been displayed individually in closely supervised areas of retail stores. As floor space and display area costs have increased significantly, manufacturers have strived to design improved packaging systems which securely retain the products in compact and attractive display configurations. Manufacturers have found multiple piece products particularly difficult to securely and attractively package. Additionally, collectible items such as model vehicles often have preferred display orientations which futher complicate packaging requirements.

It is therefore an object of the invention to provide an improved packaging system for model vehicles.

It is a other object of the invention to provide an improved packaging system for securely and attractively packaging a model vehicle and a trading card bearing matching serial numbers.

It is another object of the invention to provide a novel packaging system for a model vehicle, a display stand and a trading card having matching serial numbers.

It is yet another object of the invention to provide a novel packaging system that securely packages a model vehicle, a display stand and a trading card having matching serial numbers in preferred display orientations.

Other objects, features and advantages of the present invention will be apparent from the following description of the preferred embodiments, taken in conjunction with the accompanying drawings described below.

DETAILED DESCRIPTION OF PREFERRED EMBODIMENTS

Figure 1:
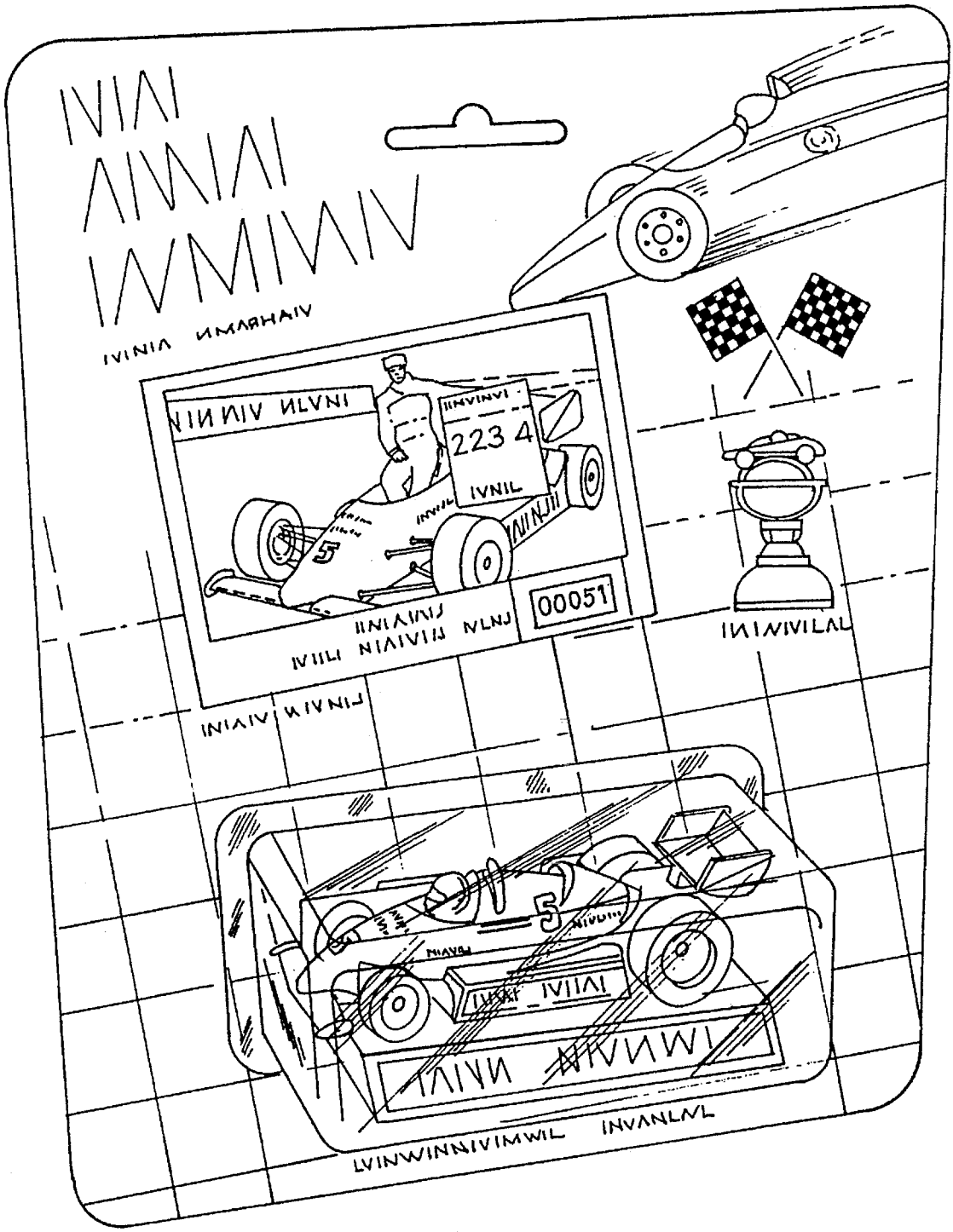
FIG. 1 is an isometric view of the front side of a package constructed in accordance with one preferred embodiment of the invention, including a model vehicle, a display stand and a trading card bearing matching serial numbers.

Referring to the Figures and more particularly to FIG. 1, a packaging system 10 constructed in accordance with the invention preferably includes a substantially rigid paper board sheet 12 of the type known in the art as a blister card. A slot 14 is provided in the sheet 12 near the top thereof to enable the sheet 12 to be hung on a conventional hook or the like. Suitable advertising and descriptive information can be printed on the face of the sheet as illustrated in FIG. 1.

In accordance with one preferred embodiment of the invention, a trading card 16 is incorporated into the sheet 12 as a unitary part thereof. A line 17 surrounding the trading card 16 is printed on the sheet 12 to facilitate removal of the trading card 16 from the sheet 12 by means of a scissors or the like. Alternatively, the trading card 16 can comprise a separate card which is held in place by a display stand 20 as described below. Although not fully shown in the Figures, information can be conventionally printed on both the front and rear sides of the trading card 16.

A space 11 is preferably left blank on the front side of the trading card 16 so that a serial number 13 can be located therein. The serial number 13 can be printed on the trading card 16 or coupled thereto in a variety of conventional ways. Preferably, the serial number 13 is printed upon adhesive labels 21 comprising gold foil. For ease of production, three labels 21 bearing matching serial numbers 13 can be printed at the same time. The labels 21 and the printing thereon can be similarly sized, but have different sizes in accordance with one preferred embodiment of the invention. The serial numbers 13 can be located in a variety of locations including those described herein.

The serial numbers 13 are preferably selected from a sequence of numbers and relate to one particular type of vehicle. For example, a sequence of serial numbers are produced for sale along with a certain number of model vehicles 22 which are copies of a famous race car driven by a well-known driver. The trading card 16 bears the serial number and includes information relating to the race car and the driver. The range of numbers and the corresponding production of the model vehicles 22, trading cards 16 and display stands 20 are preferably limited to provide a more valuable collector's edition product.

A preformed transparent plastic structure 18 is affixed to the sheet 12 below the trading card 16. The plastic structure 18 encloses the display stand 20 on which the model vehicle 22 is mounted. The plastic structure 18 can have substantially parallel top and bottom walls and substantially parallel side walls as shown in FIG. 1. Alternatively, the plastic structure 18 can be shaped to substantially conform to the shapes of the model vehicle 22 and the display stand 20. While a miniature race car 25 is shown for illustrative purposes, it will be apparent to one of ordinary skill in the art that the model vehicle 22 can comprise a variety of vehicles.

Figure 5:
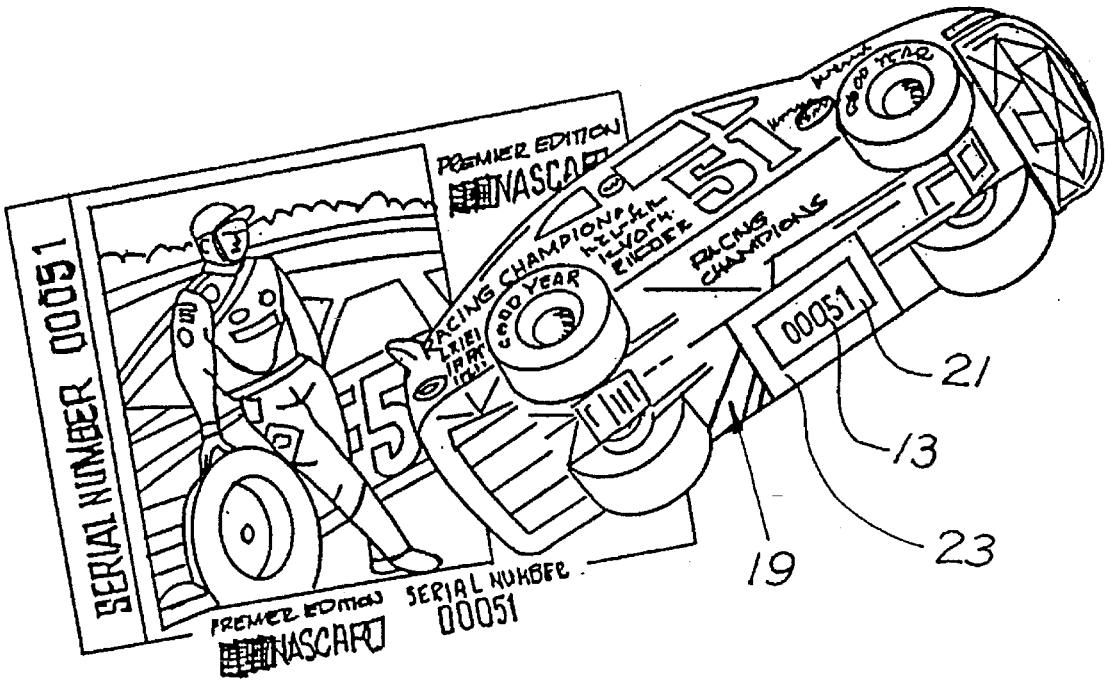
FIG. 5 is a bottom view of the model vehicle showing the model vehicle chassis and matching serial number.

The model vehicle 22 includes a chassis portion 19 at the bottom of the model vehicle 22 as illustrated in FIG. 5. The chassis portion 19 includes a flat portion 23 to which one of said labels 21 is preferably coupled.

Figure 4:
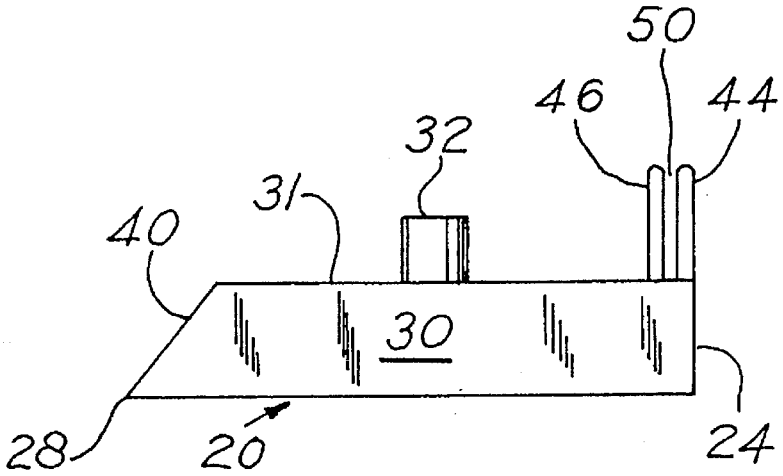
FIG. 4 is an elevational view taken from the right hand side of FIG. 3.

As shown in FIG. 4, the display stand 20 includes a planar rear wall 24 which abuts the front face of the sheet 12 in the package 10 shown in FIG. 1. The plastic structure 18 includes a planar front wall 26 which abuts the front edge 28 of the display stand 20 when the rear flange 30 is positioned against the front face of the sheet 12 as shown in FIG. 1. In this manner, the display stand 20 is maintained in a fixed position with the package 10.

The display stand 20 includes a base section 30 having a platform surface 31 on the top. In another preferred embodiment, an upwardly extending cylindrical lug 32 extends from the top of the platform surface 31. The model vehicle 22 is disposed on the display stand 20 with the wheels 34 of the model vehicle 22 resting on the platform surface 31. The lug 32 extends upwardly into a shallow cylindrical recess 36 provided in the bottom of the model vehicle 22. The recess 36 is complementary to the lug 32 to prevent relative horizontal movement between the model vehicle 22 and the display stand 20. While the model vehicle 22 and the display stand 20 are in the package 10, the top wall 38 of the plastic structure 18 engages the top of the model vehicle 22 and the bottom wall 39 engages the bottom of the display stand 20 to prevent relative vertical movement between the model vehicle 22 and the platform 31.

Figure 2:
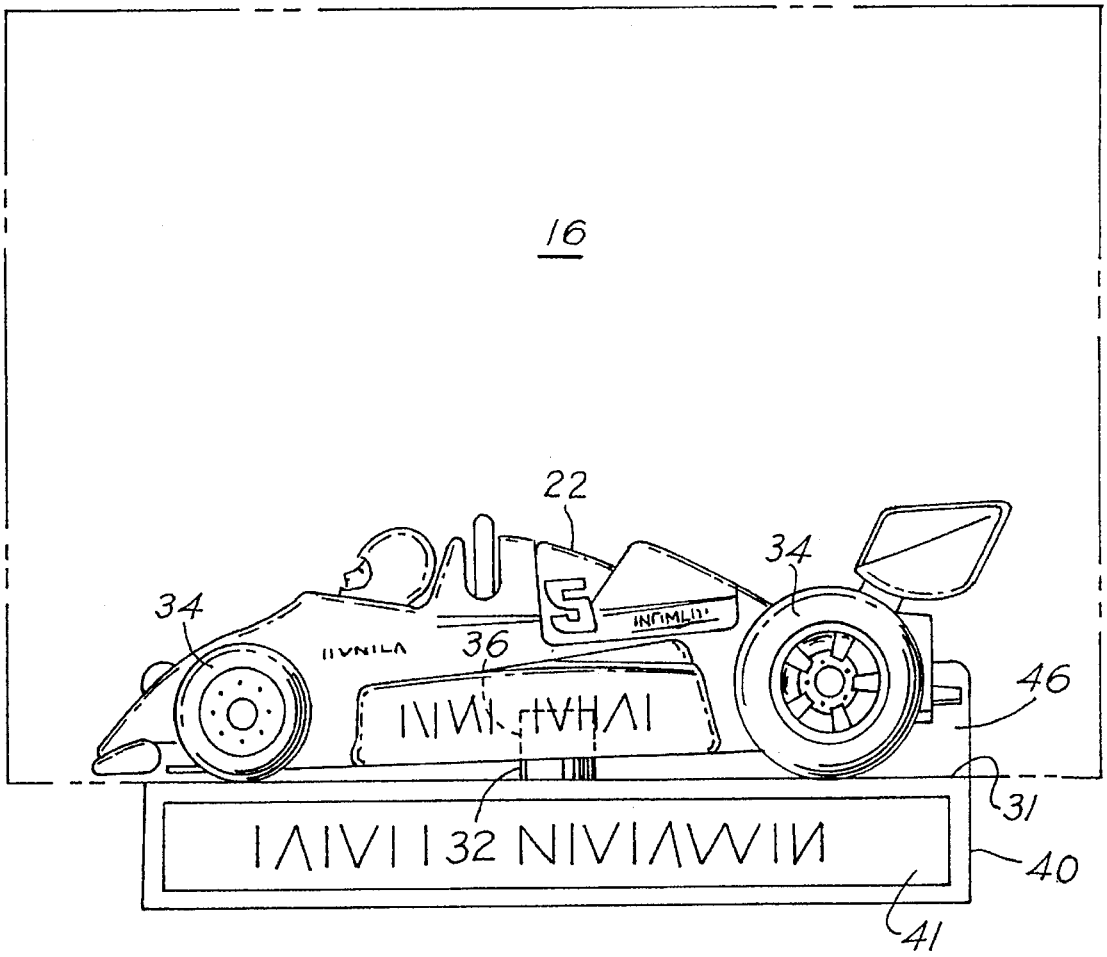
FIG. 2 is a front elevational view of the model vehicle, the display stand and the trading card of FIG. 1.
Figure 3:
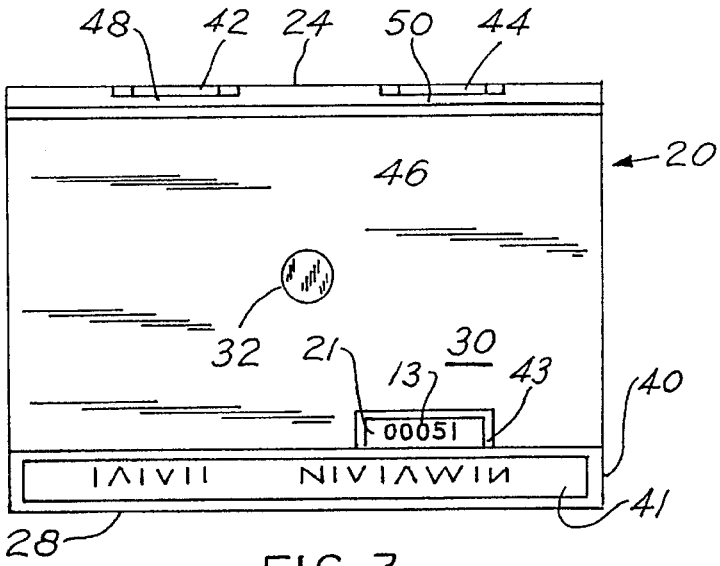
FIG. 3 is a plan view of the display stand.

The display stand 20 has a rearwardly canted front wall 40 which can carry a sign or the like 41 identifying the model vehicle 22. The display stand 20 further preferably includes a label portion 43 for a label 21 bearing the serial number 13. Extending upwardly from the platform surface 31 at the rear thereof are a pair of planar integral tabs 42 and 44 having rear surfaces which are coplanar with the rear wall of the platform 31. An upwardly extending planar member 46 extends upwardly from the surface 31 a short distance forwardly of the tabs 42 and 44 to define a pair of aligned slots 48 and 50 for receiving the bottom portion of the trading card 16 as shown in FIG. 2. The slots 48 and 50 each have a width when the tabs 42 and 44 are in the unstressed state which is slightly less than the thickness of the trading card 16. Therefore, when the trading card 16 is pushed down into the slots 48 and 50, the tabs 42 and 44 firmly grip the trading card 16 to hold it in place on the display stand 30.

Accordingly, the present invention provides a secure and attractive packaging system 10 for displaying model vehicles and related accessories. In the most preferred embodiments of the invention, the packaging system 10 enables the model vehicles and accessories to be packaged in preferred display orientations for optimal visual impact.

Certain materials and material properties have been described for illustrative purposes. It will be apparent that such descriptions are not intended to be exhaustive or limiting. For example, the sheet 12 can comprise a wide range of materials suitable for accepting conventional printing. As a further example, the display stand 20 can comprise any durable material, although preferably metal or plastic are used. Accordingly, while preferred embodiments of the invention have been shown and described, it will be clear to those skilled in the art that various changes and modifications can be made without departing from the invention in its broader aspects as set forth in the provided claims.

What is claimed is:

1. A package system, comprising:

a model vehicle bearing a predetermined serial number corresponding to one of a sequence of numbers in a limited range;

a trading card bearing said serial number;

a package for retaining said model vehicle and said trading card, said package including a substantially rigid sheet disposed adjacent said model vehicle and said trading card; and a display stand having a platform for removably supporting said model vehicle, wherein said display stand also bears said serial number.

2. The package system as defined in claim 1, wherein said serial number is printed upon each of three labels and one said label is coupled to said model vehicle, another said label is coupled to said display stand and another said label is coupled to said trading card.

3. The package system as defined in claim 2, wherein said labels comprise adhesive-backed gold foil.

4. The package system as defined in claim 2, wherein said labels have differing sizes.

5. The package system as defined in claim 2, wherein said trading card forms a removable portion of said sheet.

6. The package system as defined in claim 2, wherein said model vehicle comprises a miniature race car.

7. A package system, comprising:

a model vehicle bearing a predetermined serial number corresponding to one of a sequence of numbers in a limited range;

a trading card bearing said serial number;

a display stand beating said serial number and including a platform for removably supporting said model vehicle, an upwardly extending portion for holding said trading card in an upright position adjacent said platform; and a package for retaining said model vehicle and said trading card, said package including a substantially rigid sheet disposed adjacent said model vehicle and said trading card.

8. The package system as defined in claim 7, wherein said trading card forms a removable portion of said sheet.

9. The package system as defined in claim 7, wherein said model vehicle comprises a miniature race car.

10. The package system as defined in claim 7, wherein said serial number is printed upon each of three labels and one said label is coupled to said model vehicle, another said label is coupled to said display stand and another said label is coupled to said trading card.

11. The package system as defined in claim 10, wherein said labels comprise adhesive-backed gold foil wherein one of said labels is placed on a flat portion of said display stand and another of said labels is placed on a flat portion in a chassis of said model vehicle.

12. The package system as defined in claim 11, wherein said labels have differing sizes.

* * * * *